United States Patent [19]

Gieles

[11] Patent Number: 4,718,386

[45] Date of Patent: Jan. 12, 1988

[54] FUEL INJECTOR

[75] Inventor: Wilhelmus T. M. Gieles, Eindhoven, Netherlands

[73] Assignee: Volvo Car B.V., Netherlands

[21] Appl. No.: 871,525

[22] Filed: Jun. 6, 1986

[30] Foreign Application Priority Data

Jun. 6, 1985 [NL] Netherlands ..... 8501647

[51] Int. Cl.[4] ..... F02B 3/00

[52] U.S. Cl. ..... 123/472; 251/129.01; 123/499; 239/585

[58] Field of Search ..... 123/472, 499, 497; 251/129.01; 239/585

[56] References Cited

U.S. PATENT DOCUMENTS

| | | | |
|---|---|---|---|
| 3,053,497 | 9/1962 | Fraenkel | 251/129.01 |
| 3,464,627 | 9/1969 | Huber | 123/472 |
| 4,275,693 | 6/1981 | Lechie | 123/472 |
| 4,284,051 | 8/1981 | Maisch | 123/499 |
| 4,327,695 | 5/1982 | Schechter | 123/499 |
| 4,351,299 | 9/1982 | Costello | 123/472 |
| 4,544,129 | 10/1985 | Ichiryu | 251/129.01 |

*Primary Examiner*—Ronald B. Cox

*Attorney, Agent, or Firm*—Ostrolenk, Faber, Gerb & Soffen

[57] ABSTRACT

A fuel injector comprising an injector body having a cylindrical bore containing a plunger connected to a moving part of an electromagnetic drive system, and is provided with a detector for the plunger displacement the moving part of the drive system being formed by a cylindrical winding positioned in the annular air gap of the magnetic circuit of the drive system.

4 Claims, 2 Drawing Figures

FUEL INJECTOR

BACKGROUND OF THE INVENTION

The invention relates to a fuel injector comprising an injector body having a cylindrical bore communicating with a fuel supply passage and containing a plunger which can move in the longitudinal direction and which is connected to a moving part of an electromagnetic drive system to be energized by a current with pulse-shaped waveform supplied by a controlled power source, and which is provided with a detector for the plunger displacement whose output signal is supplied as a feedback signal to the power-source control circuit.

DESCRIPTION OF THE PRIOR ART

Such a fuel injector is known from European patent application No. 0,055,116. In said known injector, the drive system is formed with a substantially cylindrical armature coupled to the plunger and enclosed by an energizing winding coaxial thereto and cooperating with a truncated conical stator extending into the armature.

Said known fuel injectors has the drawback that the armature mass is relatively large resulting in an appreciable mass inertia. Consequently, great forces are required to cause the plunger to make a predetermined fast and controlled stroke. Such force can be generated only by using in the electric circuit a winding with many turns, resulting into an appreciable self-induction, which precludes a rapid variation of the current intensity. Consequently, said known fuel injector will not be able to inject small quantities of fuel accurately and, further-more, will be less suitable for high engine speeds.

SUMMARY OF THE INVENTION

The object of the invention is to provide a fuel injector of very simple design in which said drawbacks are eliminated. To this end, according to the invention, the moving part of the drive system is formed by a cylindrical winding positioned in the annular air gap of the magnetic circuit of the drive system.

This construction results in a very small mass of the moving part of the drive system, and therefore in a small inertia as well, thus affording an accurately defined, short plunger stroke, a controlled variation of the speed and a high repetition frequency to be attained.

Preferably, the magnetic flux in the magnetic circuit is generated by a permanent magnet. The modern permanent magnetic materials enable very high fluxes to be attained, as a result of which the winding can be made with a small number of turns and the self-induction remains limited, thus ensuring fast operation.

The displacement detector is preferably formed with a combination of a permanent magnet and a magnetoresistive sensor, one part of which is stationary and the other part of which is coupled to the piston. A suitable magnetoresistive sensor is for instance the one described in the article: "The KMZ 10 Magneto-resistive Sensor", Philips Technical Publication 102.

The power-source control circuit may be designed to supply an energizing current pulse with opposite polarity at the end of the excitation period. This control feature ensures fast stopping of the plunger and subsequent return to its starting position.

In a modified embodiment, the bore is in communication with the fuel supply passage through an inlet opening which is closed by the plunger during the first part of its stroke. In this case, there is no need for a one way valve to be provided in the fuel supply duct leading to the bore.

DESCRIPTION OF A PREFERRED EMBODIMENT

Figure 1A:
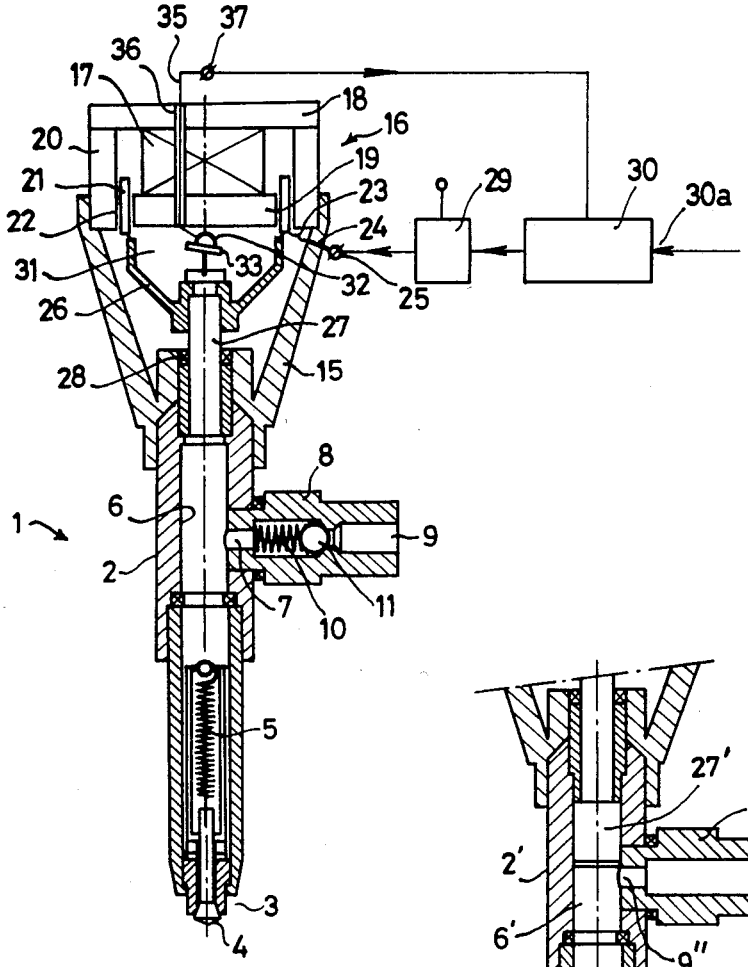
FIG. 1*a* shows an exemplied embodiment of the fuel injector according to the invention with a schematic representation of the power source cooperating therewith and the control circuit therefor.

The fuel injector 1 shown in FIG. 1*a* comprises an elongated cyclindrical body 2 which at the lower end is provided with the injection nozzle 3 closed by the valve 4 which is under the influence of the spring 5 normally holding the valve 4 in the closed position. The fuel supply duct 7 formed in the connecting member 8 screwed into the body 2 leads into the cylindrical bore 6 of said body 2; the fuel is supplied through the bore 9 which, at the end facing said body, is closed by the ball 11 under the influence of the spring 10.

At the top side, the body 2 carries, on the bracket 15, a magnetic circuit 16 with the permanent magnet 17, the plates 18 and 19 and the cylindrical enclosure 20. In the air gap 21 located between the lower inner edge of the cylinder 20 and the plate 19 there is provided a winding 22 whose connecting wires 23 lead, at 24, through the bracket 15 to the outside to a connecting point 25. The winding 22 is provided on the support 26 which merges into the top of the plunger 27; the latter is slidably disposed in the bore 6 via the sealing 28.

The connecting point 25 is connected to the power source 29 which is controlled by the control circuit 30; an energizing current of suitable amplitude and polarity causes the winding 22 and, consequently, the plunger 27 to be axially displaced in a particular direction and over a particular distance.

Said distance, i.e. the plunger stroke, is detected by a plunger displacement detector 31 formed by a magnetoresistive sensor 32, secured to the disk 19, and a disk-shaped magnet 33 cooperating with said sensor and secured to the plunger 27 and so moving along therewith. The arrangement corresponds to the one shown in FIG. 7 of the article: "The KMZ 10 Magnetoresistive Sensor", Philips Technical Publication 102. The electrical wires 35 connected to the magnetoresistive sensor 32 lead to the outside via a bore 36 in the magnetic circuit; the connecting point 37 connects to the control circuit 30.

Said control circuit 30 receives, at the connecting point 30*a*, a main control signal representing the injection moment and the quantity of fuel to be injected. The control circuit 30 and the power source 29 can be integrated into the electronic part for computing the quantity and moment of injection desired.

The device operates as follows:

Fuel under a specified pressure is supplied through the duct 9 and fills the bore 6 of the body 2 between the lower end of the plunger 27 and the valve 4. The control unit 30 computes, on the basis of the control signals transmitted thereto, the amplitude of the exciting current to be supplied by the power source 29 to the winding 22 and required for bringing about the stroke of the plunger 27 corresponding to the quantity of fuel injected. A corresponding control signal is transmitted, at the injection moment desired, to the controlled power source 29 energizing the winding 22, as a result of which the plunger moves downwards over a predetermined distance; when the pressure in the bore 6 exceeds a predetermined value, the spring-loaded valve 4 opens and the fuel is injected. Upon termination of the energizing current pulse, plunger 27 and winding 22 will come to a stop under the influence of the fuel pressure and friction occurring in the bore 6. Conceivably, stopping can be accelerated by energizing the winding 22 with a brief current pulse having a polarity opposite to the exciting current pulse, whereupon the piston returns to its starting position. In the meantime, the magnetoresistive sensor 32 of the displacement detector 31 has transmitted to the control unit 30 a signal which is representative of the actual displacement of the plunjer 27 and so of the quantity of fuel actually injected. If this stroke proves not to correspond to the quentity of fuel desired, there is generated an error signal which adjusts the control signal for the subsequent injection - in principle proceeding in the manner as described in European patent application No. 0,055,116.

Figure 1B:
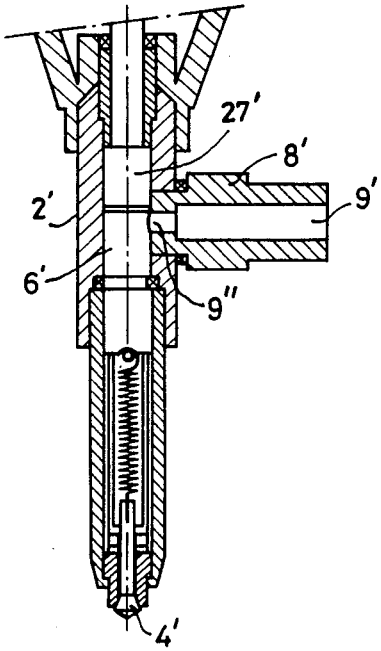
FIG. 1*b* shows a modified form of the lower part of this injector.

FIG. 1*b* shows the lower part of an embodiment according to the invention wherein the spring 10 and the ball valve 11 have been omitted (which simplifies the construction), in which case the plunger stroke must be greater. The fuel supply duct 9' leads directly into the bore 6' which obviously remains continuously filled with fuel; in the downward part of its stroke, the plunger 27' will first close the opening 9'' of the bore 9' and will, only after closing, compress the fuel present underneath the piston. Upon reaching a specified pressure, this fuel is injected via the valve 4'.

Although this embodiment has the advantage of a simplified construction, there remains the fact that the plunger is not urged back by the fuel pressure, but is in fact to be returned to its starting position by another, upwardly directed force. However, due to the construction of the plunger drive system specific to the invention, said force can be generated by a current pulse of opposite polarity through the winding 22.

What is claimed is:

1. A fuel injector comprising an injector body having a cylindrical bore therein, a fuel supply passage communicating with the bore;

a plunger contained within and movable in the longitudinal direction through the bore; a cylindrical winding, the plunger being connected to the winding;

a permanent magnet circuit, including an annular air gap and the winding being positioned in the air gap, a controlled power source for supplying a current with a pulse shaped wave form, the power source being connected with the winding for supplying current to the winding, the power source including a control circuit, the power source further comprising a plunger displacement connector comprised of a permanent magnet and a magneto-resistive sensor, one part of the combination being stationary and the other part of the combination being coupled to the plunger for being moved by movement of the plunger, the output signal of the sensor being supplied as a feedback signal to the power source control circuit for controlling the power source.

2. A fuel injector according to claim 1, further comprising a permanent magnet for generating the magnetic flux in the magnetic circuit.

3. A fuel injector according to claim 1, wherein the power-source control circuit supplies an energizing current pulse with opposite polarity at the end of the energizing period.

4. A fuel injector according to claim 1, wherein the bore is in communication with the fuel supply passage via an inlet opening which is to be closed by the plunger during the first part of its stroke.

* * * * *